US006156962A

United States Patent [19]

Poort

[11] Patent Number: 6,156,962

[45] Date of Patent: Dec. 5, 2000

[54] STRINGED INSTRUMENT WITH AN OBLIQUE NUT

[75] Inventor: Aristides Folkert Poort, Den Haag, Netherlands

[73] Assignee: Catalyst Corporate Development B.V., Ht Delft, Netherlands

[21] Appl. No.: 09/304,846

[22] Filed: May 5, 1999

[51] Int. Cl.[7] ..... G10D 3/06

[52] U.S. Cl. ..... 84/314 N

[58] Field of Search ..... 84/314 N, 267, 84/293, 298, 307

[56] References Cited

U.S. PATENT DOCUMENTS

| | | | |
|---|---|---|---|
| 4,311,078 | 1/1982 | Falgares | 84/314 R |
| 5,481,956 | 1/1996 | LoJacono et al. | 84/314 N |
| 5,600,079 | 2/1997 | Feiten et al. | 84/312 R |
| 5,750,910 | 5/1998 | LoJacono | 84/314 N |

*Primary Examiner*—Bentsu Ro
*Assistant Examiner*—Kim Lockett
*Attorney, Agent, or Firm*—Young & Thompson

[57] ABSTRACT

A stringed instrument having a body and a neck with a fingerboard extending from the body. The body has a bridge for supporting first end portions of a plurality of strings arranged in a series of decreasing thickness, and a nut at an end of the fingerboard is placed so as to provide support for a second end portion of the plurality of strings. The fingerboard has a pluarlity of frets located between the bridge and the nut, where the first fret is defined as the fret closest to the nut. The distance between the nut and the first fret for each of the plurality of strings is inversely proportional to the thickness of the corresponding string so that a thin, high pitched string has a greater distance between the nut and the first fret than does a thicker, lower pitched string.

12 Claims, 3 Drawing Sheets

STRINGED INSTRUMENT WITH AN OBLIQUE NUT

BACKGROUND OF THE INVENTION

A stringed instrument having a body and a neck from the body with a fingerboard on that neck, the body being provided with a bridge for supporting first end portions of a plurality of strings, a nut with predetermined fixed loci for supporting second end portions of said plurality of strings being provided near an end of the fingerboard, away from the body, and that fingerboard being provided with a plurality of frets between said bridge and said nut, a first fret being defined as the fret closest to the nut, said loci having front portions located at a side of the nut facing said first fret and being designed to support a plurality of strings arranged in accordance with a series of decreasing thickness, each front portion of said loci having a predetermined fixed distance to said first fret.

Since quite some time, it is known that guitars in their most basic form, i.e., with frets, placed according to the well-known "1/18th rule", suffer from bad intonation. The 1/18-rule states that the ratio between the distance from one fret to the bridge and the distance from an adjacent fret to that bridge equals the twelfth root of 2. The bad intonation is mainly due to the elongating of the sting as a result of the longer path the string has to travel from bridge to nut when the string is pressed towards the fingerboard by a user's finger. The string no longer follows the shortest route, but goes from the bridge to the fingerboard, partially follows the shape of the finger and goes back up again to the nut.

For example, in U.S. Pat. No. 5,570,910 a method is disclosed to obtain better intonation. An adjustable bridge and an adjustable nut are used to compensate for the length changes of the strings. In this way, the intonation of the guitar can be controlled on two sides of the strings and a perfect intonation is accomplished. Guitars of today, however, are seldom equipped with both an adjustable nut and an adjustable bridge, as they are complex to build and thus expensive. Also, with both the bridge and the nut being adjustable, adjusting a guitar to a perfect intonation is not an easy task, since the position of the nut, the position of the bridge and the position of the frets are codependent. Adjusting the instrument to a perfect intonation becomes a process of trial and error, but a perfect intonation for all strings can be accomplished though. A further drawback of adjustable nuts is that they worsen the tone quality. This is mainly because they are made of separate parts and thus do not guide the vibrations from the strings to the guitar very well.

In U.S. Pat. No. 5,728,956 an alternative nut is disclosed that can be used in combination with an adjustable bridge. According to this publication, the elongation of the fretted strings is compensated by shortening the distance between the nut and the first fret by approximately 3.3%. It is claimed that this results in an accurate intonation on all fret positions.

The latter solution, however, does not take into account the uneven sensitivity for elongation of different string types. For example, thinner strings tend to cut into the flesh of the finger relatively more than thicker strings. Therefore, the thinner strings may be less flexed in the area where they are pressed down to the fingerboard than thicker strings are.

Since, apparently, a relation exists between the elongation of the string, whatever its source, and its physical properties and dimensions, the nut should be adapted for that to obtain a better intonation.

SUMMARY OF THE INVENTION

The main goal of the current invention is to provide a fretted instrument with improved intonation without the burden and costs and the worse tonal quality of the adjustable nut of U.S. Pat. No. 5,570,910, but with better intonation than with the 3.3%-rule according to U.S. Pat. No. 5,728,956. The nut according the current invention should be cheap, robust, easy to apply to ordinary fretted instruments and easy to tune with, while the tone of the instrument remains unaffected.

These goals are met by a stringed instrument as defined at the outset and wherein each of the distances between each respective front portion of said loci and said first fret is selected to be smaller with increasing thickness of the string to be supported by each said respective front portion.

In this way, compensation can be obtained for the increase in tension in the string, due to its elongating, whatever sources this elongation originates from, depending on its physical properties and its dimensions. This results in a better-intonated instrument. The better intonation is especially audible when thicker strings are played at lower positions, i.e. closer to the nut, since the change of tension, as a result of the elongating of the string, is most significant for thicker strings at those positions.

Since the nut is not adjustable, it can be made quite like an ordinary nut. The main difference being that the front portions of the loci lay on a line, which is orientated obliquely to the frets. A normal nut could be used also, but would have to be mounted obliquely to obtain the desired effect. Both nuts, oblique in shape or obliquely placed, will cut down the costs, compared to an adjustable nut, while the intonation will improve compared to a non-adjustable, non-oblique or normal nut and the tonal quality remains unaffected.

Most likely, the front portions of the loci are located on either a substantially straight line or on a bow-like, curved line. Tests have shown that a nut with a straight oblique side, in combination with e.g. an ordinary adjustable bridge, will improve the intonation drastically compared to a normal nut.

Due to its simple form, the nut according to the present invention can keep a substantially bar shaped form and it can be made out of materials used for ordinary nuts. Commonly used materials are plastic, bone, ivory, graphite, brass, steel and wood, but other materials are applicable as well. Consequently, the costs may be kept low and the tonal qualities may be kept high.

Due to wearing of the notches (the groove that positions the strings on the nut) normal nuts have to be replaced. Since the nut according to the present invention strongly resembles a normal nut, the location in which the nut is mounted does not have to be adapted. So, an ordinary nut can easily be replaced by a nut adapted to function according to the present invention.

The distance between the front portions of the loci of the nut according to the present invention and the first fret will be decreased several percent depending on the type of string. For the thinner strings, the distance may vary 0 to 5%, preferably 0 to 3%, while for the thicker strings it may be 2 to 11%, preferably 4 to 9%, but larger or smaller deviations are possible as well.

The present invention also relates to a nut for a stringed instrument that has a groove arranged for accommodating that nut. The nut being provided with a lower portion arranged to be accommodated in said groove and extending in a first direction. The nut has predetermined fixed loci with front portions at an edge located at an upper portion of the nut for supporting end portions of a plurality of strings, said end portions being arranged on a line which is not parallel to said first direction.

BRIEF DESCRIPTION OF THE DRAWINGS

In the next section the invention will be described by way of a non-limiting example, with reference to the drawings, in which.

DETAILED DESCRIPTION OF THE PREFERRED EMBODIMENTS

Although the drawings show a guitar, the invention is equally well applicable to other fretted instruments.

Figure 1:
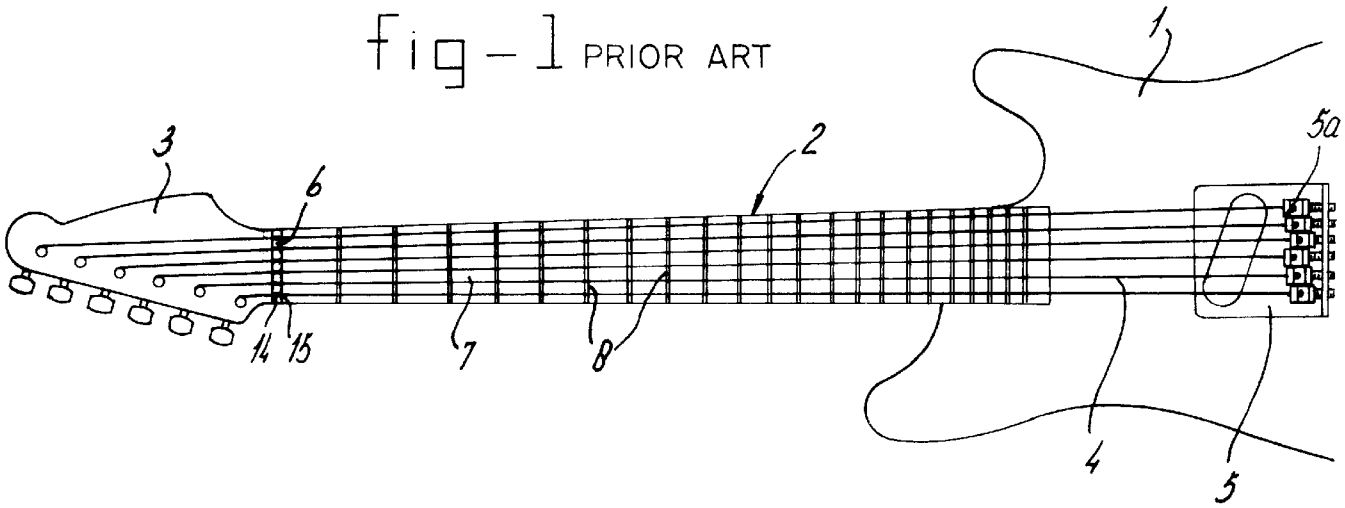
Fig-1 PRIOR ART
FIG. 1 shows part of an electrical guitar according to the state of the art.

Referring to FIG. 1, an electrical guitar according to the prior art is shown comprising a body 1, a neck 2 and a headstock 3. The strings 4 are on one end supported by an adjustable bridge 5 and on their opposing ends by a conventional nut 6. A fingerboard 7 is mounted on the neck 2 and is provided with frets 8, according to the well known 1/18th rule, to obtain an equal-tempered scale.

On guitars like this, the length of the vibrating part of each unfretted or open string is on the one hand determined by the position of the nut 6, which is assembled at the end of the fingerboard 7, or more precisely, by the front portions 15 of the loci 14, where the strings are first let free from the nut 6 and by the position of the saddles 5*a* of the bridge 5, which is assembled on the body 1. This length in combination with the string material properties, dimensions and tension, determine the pitch of each open string. Thick or heavy strings have a relative low pitch, while high tension increases the pitch on a regular stringed instrument.

On a guitar, the player can lower the length of the vibrating part of the string by pressing it down to the fingerboard 7, close to a fret 8, the so-called fretting of the string. The string will be shortened and the frequency of the tone will be higher, see FIG. 2.

Figure 2:
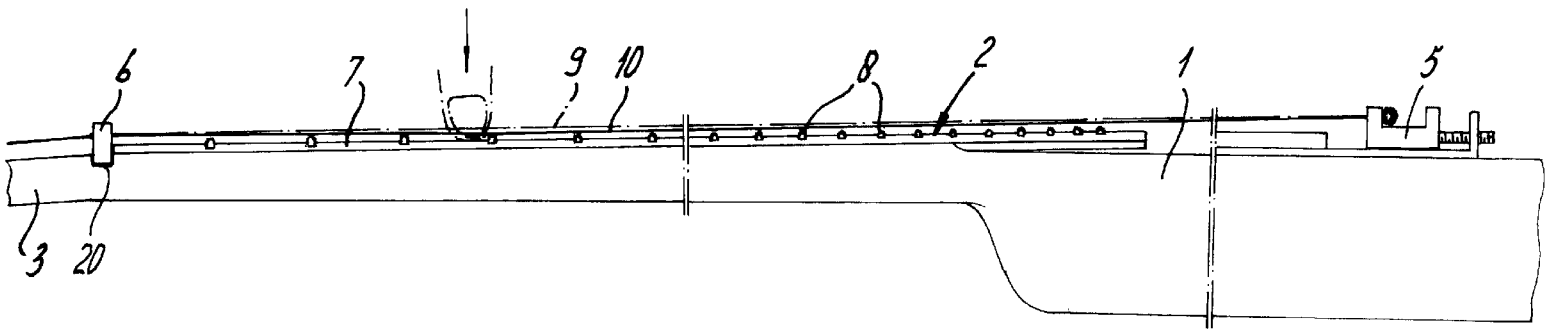
Fig-2 PRIOR ART
FIG. 2 shows a side view of the electrical guitar from FIG. 1.

A side effect of pressing down the string is that the path of the string from the nut to the bridge is elongated. This effect is shown in FIG. 2. Again, the bridge is indicated with reference number 5, the nut by 6 and the frets by 8. The open string is indicated by 9 while 10 indicates the string in pressed down position. It may be clear that in pressed down position the string follows a longer path between the bridge 5 and the nut 6 and thus the string has be elongated. The path of the string is also influenced by the shape of the finger, the hardness of the skin of that finger, the amount of pressure of that finger and the physical properties and dimensions of the string. A hard skinned finger pressed down with much force on a thick string will cause that string to flex between two adjacent frets and thus elongate the string even more. While a soft fingertip pressed slightly on a thin string will hardly influence its path. The total elongation of the string will increase the tension in the string depending of the material it is made of and thus increase its pitch.

So, even if the length of the vibrating part of the fretted string and the tension of that string when not fretted are exactly right, the tension of the string is pressed down position will be somewhat high, because of said influences.

When the string is pressed down in the middle of the fingerboard 7, the deviation of the tone is relatively small, compared to when pressed down near the nut 6 where the deviation is relatively larger. This is mainly due to two effects. The elongation caused by the triangular path the string follows is relatively small when the string is fretted in the middle of the fingerboard, compared to when it is fretted, say, near the nut 6. This follows from simple geometry. An other important effect is caused by the, above-mentioned, flexing of the string by the tip of the finger. When the string is pressed down in the middle of the fingerboard 7 the flexing of the string is relatively small because the shape of the tip of the finger substantially follows the local natural curvature of the string. When the string is fretted, say, in the first position, the curvature of the string is not as well adapted to follow the form of the finger. Consequently, the force needed to get the string to the fingerboard, when fretted near the nut, following the shape of the finger, will be larger than when fretted in the middle of the fingerboard. Therefore, fretting near the nut will sharpen the pitch relatively much more.

Figure 3:
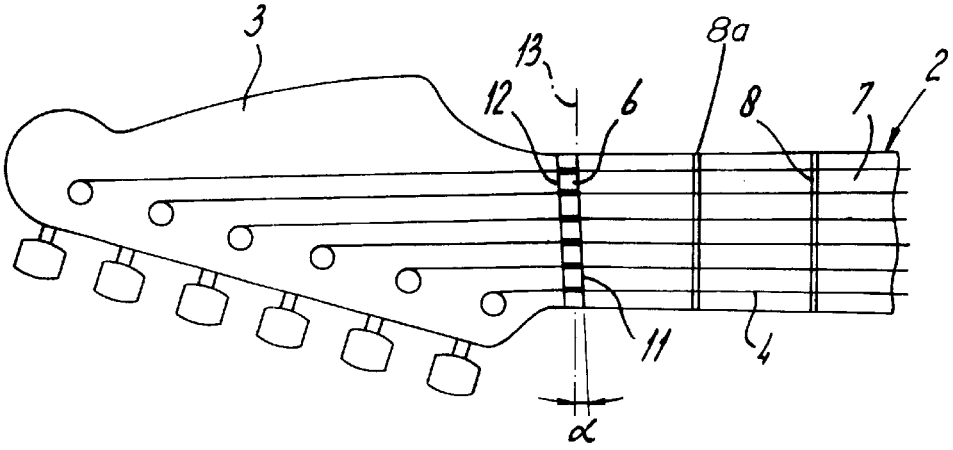
FIG. 3 shows the headstock and part of the fingerboard from FIG. 1 with a nut according to the invention.

Referring now to FIG. 3, the distal end of the neck 2 and the headstock 3 from FIG. 1 are shown. The nut 6, unlike FIG. 1, is, according to the present invention, positioned in an oblique manner. The nut has a front side 11 facing towards the bridge 5 (not shown in FIG. 3). The strings 4 extend in a longitudinal manner toward bridge 5. In the prior art, the frets 8 and the nut are parallel. However, in accordance with the present invention an angle $\alpha$ between the original intonation line 13, which is parallel to the frets and a line through the front portions 15 of the loci 14 will deviate from 0° . The angle $\alpha$ has been exaggerated in FIGS. 3 through 6 to show the angle more clearly. In the embodiment of FIG. 3, the nut 6 has a straight front side 11. For certain string-combinations (e.g. different types or sizes of strings for the high and the low strings) a non-linear front side 11 may give a more satisfactory result.

According to the present invention, the distance between the nut 6 and the first fret 8*a* is shortened, especially for the thicker strings. This causes the vibrating length of the fretted string to be relatively larger than the non-vibrating part. This decreases the pitch, which is compensated for by the increase of pitch due to pressing down the string and the resulting higher tension in the string.

Figure 4:
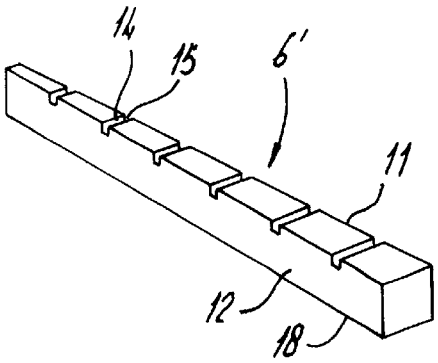
FIG. 4 shows a nut according to the present invention with a straight front side.

Now referring to FIG. 4, an alternative embodiment of the nut according to the present invention is shown. The nut 6 in FIG. 3 was a slightly rotated normal nut. FIG. 4 now shows an oblique nut 6', comprising a front side 11 and loci 14 to receive strings (not shown). The loci 14 each have a front portion 15. In use, strings extend from the front portions 15 of the loci 14 in the direction of bridge (not shown). The front portions 15 of the loci 14, in FIG. 4, lay on a straight line. The nut 6' has a lower side 18 opposite to the loci 14, which is intended to be mounted to the neck of the guitar.

Normally, nut 6,6' will be mounted in a groove 20 (see FIG. 2) extending parallel to the frets 8 on the guitar neck The lower side 18 of nut 6' may be designed such that it can be mounted in groove 20 of any commonly guitar. Then, common available guitars can be used to apply the invention. No newly designed grooves 20 are necessary then.

Figure 5:
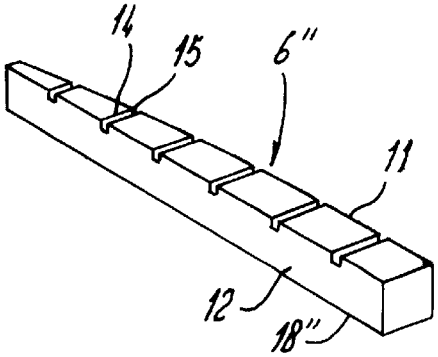
FIG. 5 shows a nut according to the present invention with a curved front side.

FIG. 5 shows a further alternative nut 6". The front portions 15 of the loci 14 lay on a curved line, which can be beneficial for some string combinations. Lower side 18" may be designed in the same way as lower side 18 of nut 6'.

Thanks to the simple configuration and strong resemblance to conventional nuts, nuts adopted according to the present invention can easily replace conventional ones. Since conventional nuts have to be replaced due to the wear down of the notches, this is a quite normal operation.

Figure 6:
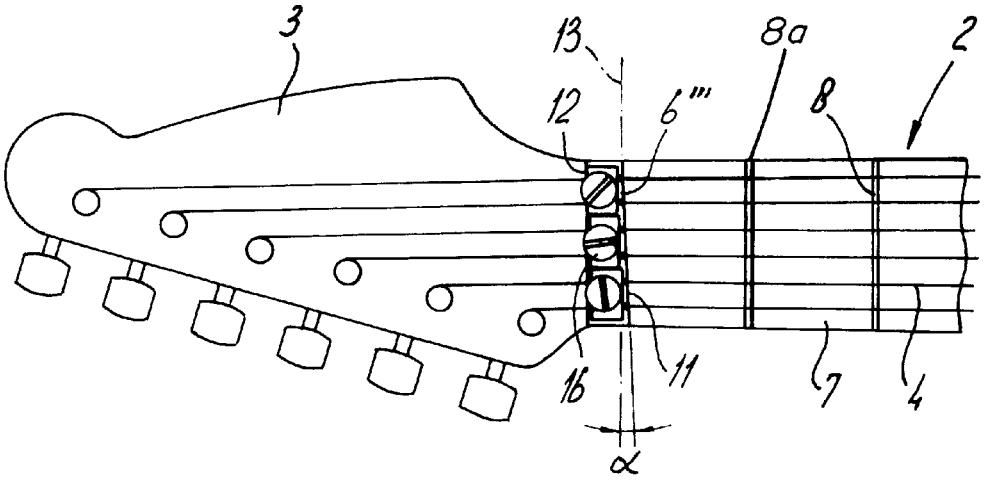
FIG. 6 shows an embodiment of a locking nut according to the present invention.

FIG. 6 shows the same headstock 3 as in FIG. 3 with a locking nut 6''' provided with screws 16 to lock one or more strings 4. Again, front side 11 of the nut 6''' makes an angle $\alpha$ with the original intonation line 13, that deviates from 0°. The screws 16 of locking nut 6''' press down the strings 4 on the nut 6''' thereby ensuring that the tuning of the instrument is unaffected by the friction between the strings and the nut.

What is claimed is:

1. A stringed instrument, comprising:

a body having a neck extending from said body;

a fingerboard extending along a surface of said neck;

a bridge on said body supporting first end portions of a plurality of strings arranged in a series of decreasing thicknesses above said fingerboard;

a nut supporting second end portions of said plurality of strings above said fingerboard, said nut being located on said neck at an end distal from said body and defining a plurality of fixed positions along a front portion of said nut, each of said plurality of fixed positions being associated with a corresponding string of said plurality of strings;

a plurality of frets on said fingerboard between said bridge and said nut, a first fret being defined as a fret closest to said nut, said front portion facing said first fret, wherein each of said plurality of fixed positions has a predetermined fixed distance to said first fret selected so as to be inversely proportional to a thickness of said corresponding string.

2. A stringed instrument according to claim 1, wherein said plurality of fixed positions are located on a straight line.

3. A stringed instrument according to claim 1, wherein said plurality of fixed positions are located on a curved line.

4. A stringed instrument according to claim 1, wherein said nut comprises one of the group consisting of plastic, bone, ivory, graphite, brass, steel, and wood.

5. A stringed instrument according to claim 1, wherein said nut comprises a bar shape.

6. A stringed instrument according to claim 1, wherein said nut comprises a wedge shape.

7. A stringed instrument according to claim 1, wherein said bridge comprises an adjustable bridge for separately intoning each of said plurality of strings.

8. A stringed instrument according to claim 1, wherein a first fixed position of said plurality of fixed positions corresponding to a thinnest string of said plurality of strings having a highest pitch and a least thickness has a first distance to said first fret which is shorter than a standard distance by an amount in the range of 0–5% of the standard distance inclusive, wherein a second fixed position of said plurality of fixed positions corresponding to a thickest string of said plurality of strings having a lowest pitch and a greatest thickness has a second distance to said first fret which is shorter than the standard distance by an amount in the range of 2–11% of the standard distance inclusive, and wherein the standard distance is defined as a distance between an original intonation line and said first fret, the original intonation line being located to intonate the stringed instrument according to an equal-tempered scale wherein a distance between one of said plurality of frets and said bridge and a distance between a next adjacent one of said plurality of frets have a ratio equal to the twelfth root of two.

9. A stringed instrument according to claim 8, wherein the first distance to said first fret is shorter than the standard distance by an amount in a first preferred range of 0–3% of the standard distance inclusive, and the second distance to said first fret is shorter than the standard distance by an amount in a second preferred range of 4–9% of the standard distance inclusive.

10. A nut for a stringed instrument having a groove extending in a first direction for receiving the nut, the nut comprising:

a lower portion for being placed in the groove, the nut having a plurality of fixed locations along an upper portion of the nut for supporting corresponding end portions of a plurality of stings of the stringed instrument, wherein said corresponding end portions are arranged in a line having a direction different than the first direction.

11. A stringed instrument, comprising:

a body having a neck extending from said body, a fingerboard extending along a surface of said neck;

a bridge on said body for supporting first end portions of a plurality of strings arranged in a series of decreasing thicknesses above said fingerboard;

a nut for supporting second end portions of said plurality of strings above said fingerboard, said nut being located on said neck at an end distal from said body and defining a plurality of fixed positions along a front portion of said nut, each of said plurality of fixed positions being associated with a corresponding string of said plurality of strings;

a plurality of frets on said fingerboard between said bridge and said nut, a first fret being defined as a fret closest to said nut, said front portion facing said first fret, wherein each of said plurality of fixed positions has a predetermined fixed distance to said first fret selected so as to be inversely proportional to a thickness of said corresponding string.

12. A stringed instrument according to claim 11, wherein said predetermined fixed distance to said first fret is selected so as to satisfy a linear inverse relationship with a thickness of said corresponding string.

* * * * *